US006759174B2

(12) United States Patent
Itoh

(10) Patent No.: US 6,759,174 B2
(45) Date of Patent: Jul. 6, 2004

(54) PHOTOCONDUCTOR FOR ELECTROPHOTOGRAPHY AND MANUFACTURING METHOD THEREOF

(75) Inventor: Naoki Itoh, Nagano (JP)

(73) Assignee: Fuji Electric Imaging Device Co., Ltd., Nagano (JP)

( * ) Notice: Subject to any disclaimer, the term of this patent is extended or adjusted under 35 U.S.C. 154(b) by 0 days.

(21) Appl. No.: 10/285,665

(22) Filed: Nov. 1, 2002

(65) Prior Publication Data

US 2003/0099889 A1 May 29, 2003

(30) Foreign Application Priority Data

Nov. 2, 2001 (JP) ..... 2001-337832

(51) Int. Cl.[7] ..... G03G 5/14
(52) U.S. Cl. ..... 430/63; 430/60; 430/131
(58) Field of Search ..... 430/63, 61, 131, 430/60

(56) References Cited

U.S. PATENT DOCUMENTS 6,136,484 A * 10/2000 Katayama et al. ..... 430/63
2001/0019804 A1 * 9/2001 Kurihara et al. ..... 430/60

FOREIGN PATENT DOCUMENTS

| | | |
|---|---|---|
| JP | 04-352159 | 12/1992 |
| JP | 10-148959 | 6/1998 |
| JP | 2000-258941 | 9/2000 |

* cited by examiner

*Primary Examiner*—John L Goodrow

(57) ABSTRACT

A photoconductor for electrophotography including a conductive substrate, an undercoat layer provided on the conductive substrate, and a photosensitive layer provided on the undercoat layer and a manufacturing method thereof. The undercoat layer contains metallic oxide fine particles and is formed by applying a coating liquid for the undercoat layer onto the conductive substrate. The coating liquid contains an organic solvent having a boiling point at $1\times10^5$Pa of about 160° C. or less and a viscosity at 20° C. of about 3.0 mPa.s or more. This improves dispersion stability of metal oxide fine particles in the coating liquid to realize a uniform undercoat layer and, in turn, provides the photoconductor with uniform electrophotographic characteristics, in particular, with uniform image characteristics and external appearance characteristics.

6 Claims, 1 Drawing Sheet

PHOTOCONDUCTOR FOR ELECTROPHOTOGRAPHY AND MANUFACTURING METHOD THEREOF

CROSS-REFERENCE TO RELATED APPLICATION

This application is related to, and claims priority to, Japanese Application No. JP 2001-337832 filed Nov. 2, 2001, the disclosure of which is incorporated herein by reference.

BACKGROUND OF THE INVENTION

1. Field of the Invention

The present invention relates to a photoconductor for electrophotography (hereinafter also referred to simply as "photoconductor") and a manufacturing method thereof. The invention more particularly relates to a layered or a single layer photoconductor having a photosensitive layer containing an organic material, and a manufacturing method thereof. The photoconductor of the invention is used in devices such as an electrophotographic printer, an electrophotographic copying machine, etc.

2. Description of the Related Art

A photoconductor has a structure in which a photosensitive layer having photoconductivity is layered on a conductive substrate. Prevailing photoconductors may be classified as single layer and layered. The single layer photoconductor has a single photoconductive layer with combined functions of charge generation and charge transport. The layered photoconductor has photoconductive layers functionally separated into a layer contributing charge generation and a layer contributing surface charge holding and charge transport. Further, in recent years, a photoconductor using organic material has been brought into practical use because of advantages of having excellent thermal stability and film formability. In such photoconductors, however, it is difficult to form mechanically stable photosensitive layers with only functional material performing charge generation and charge transport. Therefore, photosensitive layers are normally formed with resin binders and used together to form the photoconductors.

A photoconductor that has recently become mainstream is the layered photoconductor in which a charge generation layer including a charge generation material, and a charge transport layer including a charge transport material, are used. In particular, in the negative charging photoconductor, the charge generation layer is formed with organic pigments vapor deposited or dispersed in resin binder. Also, the charge transport layer includes particles of an organic low-molecular-weight compound having charge transporting properties that are dispersed in resin binder as charge transport material. In addition, in a positively charged photoconductor, a single photosensitive layer is used with charge generation material and charge generation material dispersed in resin binder.

Furthermore, to enhance the quality of printed images, an undercoat layer is generally provided between the conductive substrate and the charge generation layer or the photosensitive layer. In particular, when a photoconductor is applied to a Carson process electrophotographic device, the undercoat layer is provided under the charge generation layer or the photosensitive layer to prevent defects such as black spots and white spots from being produced on a printed image.

The undercoat layer is formed of materials such as casein, polyamide resin, polyvinyl butyral resin, polyethylene, polypropylene, polystyrene, acrylic resin, polyvinyl chloride resin, polyvinyl acetate resin, polyvinyl formal resin, polyurethane resin, epoxy resin, phenoxy resin, polyester resin, melamine resin, and silicone resin.

To prevent interference by laser exposure light and provide conductivity for the undercoat layer, dispersed in a resin of the undercoat layer are metal oxide fine particles, resin particles insoluble in a solvent of coating liquid for the undercoat layer (hereinafter simply referred to as "coating liquid"), or particles for which those resin particles are surface treated.

The metal oxide fine particle, however, has a larger specific gravity compared with that of the resin binder used in the undercoat layer. Thus, the particles are easily sedimented or separated in the coating liquid for the undercoat layer. This tends to cause nonuniformity in characteristics and nonuniformity in external appearance of the undercoat layer when the undercoat layer is formed. Therefore, for obtaining uniformity of the coating liquid for the undercoat layer, dispersion stability in the coating liquid is required for the metal oxide fine particles.

Several methods have been proposed to deal with this problem. Such methods include, for example, a dip coating method for an electrophotographic photoconductor using a solvent having specified boiling point and viscosity (see Japanese patent application JP-A-4-352159); a manufacturing method of an electrophotographic photoconductor using metal oxide fine particles surface treated by a specified coupling agent, a binder resin, and a coating liquid for an undercoating containing a specified organic solvent (see Japanese patent application JP-A-10-148959); and a coating liquid for manufacturing an electrophotographic photoconductor using a combination of a specific binder resin, titanium oxide particles, and a solvent (see Japanese patent application JP-A-2000-258941). However, none of these methods sufficiently satisfies the currently required level of dispersion stability of metal oxide fine particles. Thus, a photoconductor has been desired that provides excellent uniformity in a coating liquid for an undercoat layer without producing a poor image due to the coating liquid.

SUMMARY OF THE INVENTION

Accordingly, it is an object of the present invention to achieve a uniform undercoat layer by improving dispersion stability of metal oxide fine particles in a coating liquid for the undercoat layer of a photoconductor for electrophotography, and a manufacturing method thereof. It is also an object of the present invention to provide a photoconductor for electrophotography with uniform electrophotographic characteristics, in particular, with uniform image characteristics and external appearance characteristics.

Additional objects and advantages of the invention will be set forth in part in the description that follows, and, in part, will be obvious from the description, or may be learned by practice of the invention.

Dispersion stability of the coating liquid can be improved by bringing a boiling point and a viscosity of an organic solvent used for the coating liquid for the undercoat layer within a specified range. Such an organic solvent can eliminate nonuniformity in photosensitive characteristics and external appearance characteristics of the obtained photoconductor to obtain an excellent photoconductor having uniform characteristics.

To achieve the above and other objects according to an embodiment of the present invention, there is provided a photoconductor having a conductive substrate, an undercoat layer provided on the conductive substrate, and a photosensitive layer provided on the undercoat layer. The undercoat layer contains metallic oxide fine particles and is formed by applying a coating liquid for the undercoat layer onto the conductive substrate. The coating liquid for the undercoat layer contains an organic solvent having a boiling point at $1\times10^5$ Pa of about 160° C. or less and a viscosity at 20° C. of about 3.0 mPa.s or more.

The photosensitive layer can be either a layered type, formed with a charge generation layer and a charge transport layer, or a single layer type, which is formed in a single layer and contains a charge generation material and a charge transport material.

The organic solvent is an alcohol solvent having 4 or more carbon atoms or, alternatively, an alcohol solvent having 4 or more carbon atoms with a branch structure.

To achieve the above and other objects according to another aspect of the present invention, there is provided a method of manufacturing a photoconductor including applying a coating liquid onto a conductive substrate to form an undercoat layer. The coating liquid contains metallic oxide fine particles and an organic solvent, and the organic solvent has a boiling point at $1\times10^5$ Pa of about 160° C. or less and a viscosity at 20° C. of about 3.0 mPa.s or more.

BRIEF DESCRIPTION OF THE DRAWINGS

Additional aspects and advantages of the present invention will become apparent and more readily appreciated from the following description of the embodiments, taken in conjunction with the accompanying drawings, of which.

DETAILED DESCRIPTION OF THE PREFERRED EMBODIMENTS

Figure 1:
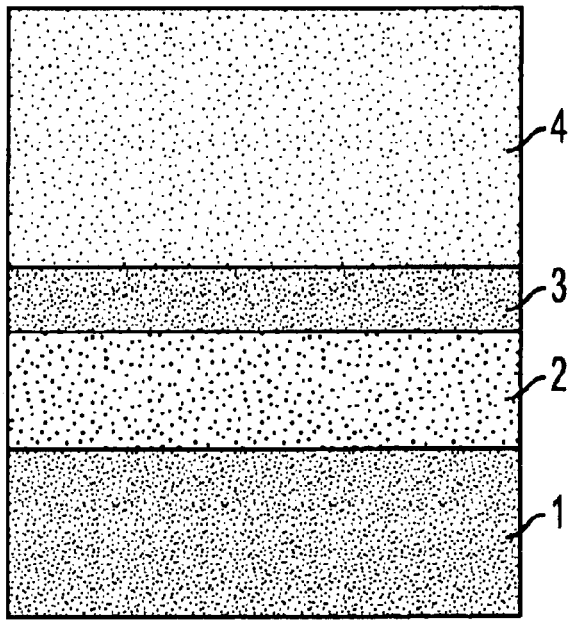
FIG. 1 is a schematic cross-sectional view showing a layered type photoconductor for electrophotography according to the present invention.

Hereinafter, embodiments of the present invention will be described in detail with reference to the attached drawings, wherein the like reference numerals refer to the like elements throughout. The present invention may, however, be embodied in many different forms and should not be construed as being limited to the embodiments set forth herein; rather, these embodiments are provided so that the present disclosure will be thorough and complete, and will fully convey the concept of the invention to those skilled in the art.

Figure 2:
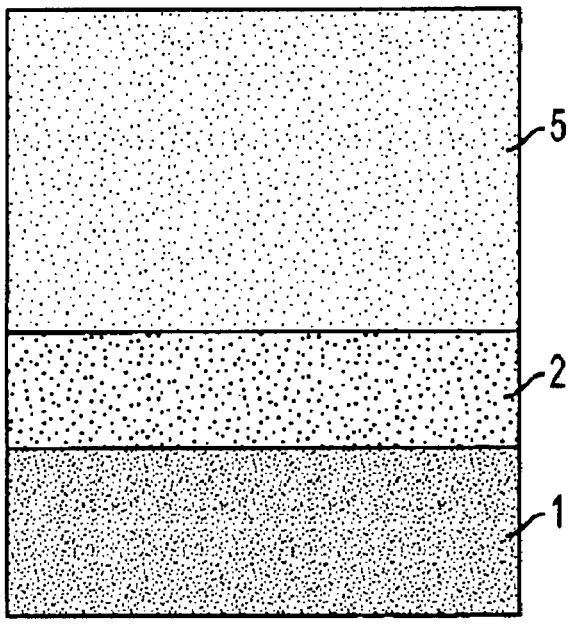
FIG. 2 is a schematic cross-sectional view showing a single layer type photoconductor for electrophotography according to the present invention.

FIG. 1 and FIG. 2 are schematic cross-sectional views showing a layered type photoconductor and a single layer type photoconductor, respectively, according to an embodiment of the present invention. In FIGS. 1 and 2, reference numeral 1 denotes a conductive substrate, reference numeral 2 denotes an undercoat layer, reference numeral 3 denotes a charge generation layer, and reference numeral 4 denotes a charge transport layer. Reference numeral 5 denotes a photosensitive layer of the single layer type photoconductor. On the charge transport layer 4 or on the photosensitive layer 5, a protective layer (not shown) may be further provided to protect the charge transport layer 4 or the photosensitive layer 5. In the following description, the photoconductor according to the embodiment of the invention will be explained with the layered type photoconductor shown in FIG. 1 used as an example.

The conductive substrate 1 plays a role as an electrode of the photoconductor and along with this, becomes a support for the other layers. The conductive substrate 1 may be formed as, for example, a cylinder, a plate, or a film. The materials forming the conductive substrate 1 may include, for example, a metal such as aluminum, stainless steel, or nickel, or the materials may include glass or resin with conductive treatment, for example.

The undercoat layer 2 prevents unnecessary charges from being injected from the conductive substrate 1 to the photosensitive layer, coats defects on the surface of the substrate 1, and improves adhesion of the photosensitive layer. The undercoat layer 2 includes, in addition to resin binder, metal oxide particles. For the resin binder, casein, polyethylene, polypropylene, polystyrene, acrylic resin, polyvinyl chloride resin, polyvinyl acetate resin, polyvinyl formal resin, polyurethane resin, epoxy resin, phenoxy resin, polyester resin, melamine resin, silicone resin, polybutyral resin and polyamide resin, and copolymers thereof can be used, for example, while being combined as required. The effect of solvent viscosity contributing to dispersion stability of a solvent according to the present invention can be expected regardless of combination with the resin binder. Therefore, when the resin binder has sufficient solubility in a solvent being used, there is no necessity for imposing limitations on the kinds of resin binders.

For metal oxide fine particles dispersed in a resin binder, $SiO_2$, $TiO_2$, $InO_2$, $ZrO_2$, and $Al_2O_3$, which have no conductivity in themselves, may be used, for example. A primary particle diameter of such a metal oxide fine particle is normally about 1 $\mu$m or less, for instance within a range from about 0.02 $\mu$m to about 0.4 $\mu$m. The metal oxide fine particles can be used with surface treatment thereof carried out with silane coupling agent for the purpose of enhancing dispersion stability and photosensitive characteristics.

Organic solvents used for coating liquids for an undercoat layer are selected to be high viscous solvents for dispersion stability of the metal oxide fine particles used as fillers in dispersion liquid. The high viscous solvents allow the fine particles to remain in suspension for a long period of time. A solvent with high viscosity of a certain level or above, however, generally has a high boiling point under normal pressure. Thus, when such a solvent is used as a solvent for a coating liquid for an undercoat layer, the solvent remains in a coated film of the undercoat layer after being dried. This is so disadvantageous as to adversely affect photosensitive characteristics or to limit a dryer used after the coating process to one that must withstand high temperature use. Therefore, in the embodiment of the present invention, an organic solvent for the coating liquid for the undercoat layer has a boiling point at $1\times10^5$ Pa (=1 atm (760 mmHg)) of about 160° C. or less, for instance about 60° C. to about 150° C. When the boiling point exceeds about 160° C., the above-described adverse effect becomes too large to make the photoconductor useful for practical applications.

Considering the viscosity of the solvent, a solvent is used having a viscosity higher than viscosities of solvents typically used, which include alcohols such as methanol, ethanol, and 1-propanol, cyclic ethers such as tetrahydrofuran, dioxane, and dioxolane, and hydrocarbon solvents such as cyclohexane, toluene, and xylene, and halogen solvents used as mixed solvents with the above solvents and including those such as chloroform, dichloromethane, and dichloroethane. For instance, alcohol solvents having 4 or more carbon atoms or, alternatively, alcohol solvents having 4 or more carbon atoms with branch structures are used. Use of a solvent with a viscosity at 20° C. of about 3.0 mPa.s or more, for instance about 3.5 mPa.s to about 10 mPa.s, or about 3.9 mPa.s to about 7.2 mPa.s, and with a boiling point at the above-described $1\times10^5$ Pa of about 160° C. or less, can enhance dispersing stability of the coating liquid for the undercoat layer and maintain good photosensitive characteristics. Also, in order to control drying speed during coating of the undercoat layer, it is also possible to use a low-boiling point solvent mixed with the high viscous solvents. The drying of the undercoat layer is carried out in an environment under atmospheric pressure (1 atm) at about 60° C. to about 160° C. for about 15 minutes to about 1 hour.

The charge generation layer 3, which generates charges when receiving light, is formed by either carrying out vacuum deposition of organic photoconductive material or by applying a coating liquid with particles of organic photoconductive material dispersed in resin binder. High charge generation efficiency is desired together with low electric field dependence in injection of generated charges to the charge transport layer 4 to provide high injection efficiency, even in a low electric field. Therefore, the organic photoconductive material can be used by adding a charge transport material to a charge generation material, the latter being a main constituent. Examples of the charge generation material include phthalocyanine pigments such as metal-free phthalocyanine, titanyl phthalocyanine, or tin phthalocyanine, azo pigments, anthanthrone pigments, perylene pigments, perinone pigments, squarillium pigments, thiapyrylium pigments, or quinacridone pigments. Combinations of the pigments can be used.

For a resin binder of the charge generation layer 3, for example, polycarbonate resin, polyester resin, polyamide resin, polyurethane resin, epoxy resin, polyvinyl butyral resin, polyvinyl acetal resin, polyvinyl chloride resin, phenoxy resin, silicone resin, methacrylate ester resin, and copolymers thereof can be used and combined as required.

The charge transport layer 4 is formed with a coating liquid applied to provide a coating using a seal coating method or a dip coating method. The coating liquid is prepared by solving a charge transport material and a resin binder in a solvent. Examples of materials that can be used as the charge transport material include hydrazone compound, styryl compound, pyrazoline compound, pyrazolone compound, oxadiazole compound, arylamine compound, benzidine compound, stilbene compound, butadiene compound, charge transporting polymers such as polyvinyl carbazole, and copolymers of resin binders and charge transport materials. Examples of resin binders include polycarbonate resin, polyester resin, polystyrene resin, and polymer and copolymer of methacrylate ester. The resin binder is combined with the charge transport material to enhance compatibility therewith, and to form the charge transport layer to ensure mechanical, chemical, and electrical stability, as well as adhesion. The thickness of the charge transport layer is within the range of about 10 $\mu$m to about 50 $\mu$m to maintain a practically effective surface potential.

Also, the object of the invention may be achieved in the single layer photoconductor shown in FIG. 2 with an undercoat layer 2 that satisfies the above requirement s. Thus, no particular limitation is imposed on a photosensitive layer 5 of the single layer photoconductor. The photosensitive layer 5 can be formed by using as required the same charge generation material, charge transport material, and resin binder as those used in the above-described layered photoconductor.

Furthermore, the photosensitive layers in both the layered and the single layer photoconductors can be provided with an antioxidant agent included therein as required to enhance stability to heat and ozone. Examples of compounds used to satisfy such a purpose include chromanol derivative such as tocophenol, or its etherified compound or its esterified compound, polyarylalkane compound, hydroquinone derivative and its monoetherified compound or its dietherified compound, benzophenone derivative, benzotriazole derivative, thioether compound, phenylenediamine derivative, phosphonate, phosphite, phenol compound, hindered phenol compound, straight-chain amine compound, cyclic amine compound, and hindered amine compound.

In addition, in each of the photosensitive layers of the layered and single layer photoconductors, an electron acceptor material can be included as necessary to enhance sensitivity, reduce residual potential, and reduce variation in characteristics in repetitive use. Examples of electron acceptor materials include compounds with high electron affinity such as succinic anhydride, maleic anhydride, dibromosuccinic anhydride, phthalic anhydride, 3-nitrophtalic anhydride, 4-nitrophtalic anhydride, pyromellitic anhydride, pyromellitic acid, trimellitic acid, trimellitic anhydride, phthalimide, 4-nitrophthal imide, tetracyanoethylene, tetracyanoquinodimethane, chloranil, bromanyl, and o-nitrobenzoic acid.

According to another aspect of the present invention, there is provided a method of manufacturing a photoconductor including making a coating liquid for an undercoat layer that contains therein metal oxide fine particles and an organic solvent having a boiling point at $1\times10^5$ Pa (=1 atm (760 mmHg)) of about 160° C. or less and a viscosity at 20° C. of about 3.0 mPa.s or more when an undercoat layer is formed on the conductive substrate by applying the coating liquid for the undercoat layer thereon. Thus, no limitation is imposed on the arrangement and forming procedure of the other layers.

EXAMPLES

The present invention is further illustrated with reference to the following examples, which are provided for illustration of the invention and are not intended to be limiting thereof.

Example 1

A solution was prepared by solving 10 parts by weight of hydroxystyrene resin and 10 parts by weight of isobutylated melamine resin as resin binders in 100 parts by weight of an isobutyl alcohol solvent. Ultra fine particles of titanium oxide were prepared with primary particle diameters of 0.03 $\mu$m to 0.05 $\mu$m. The surfaces of the particles were treated beforehand with methylhydrogen polysiloxane. Then, 80 parts by weight of the ultra fine particles of titanium oxide were mixed with the solution to be dispersed for one hour by beads mill dispersion equipment, by which a coating liquid for an undercoat layer was prepared. The viscosity of the solvent used was 3.95 mPa.s at 20° C. and the boiling point thereof was 107.9° C. at $1\times10^5$ Pa (=1 atm (760 mmHg), this value applies to the following examples).

The prepared coating liquid for an undercoat layer was applied to 10 $\mu$m on an aluminum cylinder substrate by a dip coating method before being dried at 150° C. for 30 minutes to form an undercoat layer. Following this, on the thus formed undercoat layer, a coating liquid for a charge generation layer was applied by a dip coating method to about 0.1 $\mu$m. The coating liquid was prepared by dispersing Y-type titanylphthalocyanine as a charge generation material and polyvinyl chloride-polyvinyl acetate copolymer as a resin binder in dichloroethane. The coating liquid was dried at 80° C. for 30 minutes to form a charge generation layer. Furthermore, 5 parts by weight of N,N'-bis(3-methylphenyl)-N,N'-diphenyl-1,1'-biphenyl-4,4'-diamine, 5 parts by weight of N,N,N'N'-tetrakis(4-methylphenyl)-1,1'-biphenyl-4,4'-diamin and polycarbonate Z resin with viscosity-average molecular weight of 50,000 were solved by 80 parts by weight of dichloromethane solvent and applied by a dip coating method to form a layer with a thickness of 28 μm. The layer was thereafter dried at 100° C. for 60 minutes to form a charge transport layer. Thus, a photoconductor was manufactured.

Example 2

A solution was prepared by solving 10 parts by weight of hydroxystyrene resin and 10 parts by weight of isobutylated melamine resin as resin binders in 100 parts by weight of 2-methyl-1-butanol as a solvent. Ultra fine particles of titanium oxide were prepared with primary particle diameters of 0.03 μm to 0.05 μm. The surfaces of the particles were treated beforehand with methylhydrogen polysiloxane. Then, 80 parts by weight of the ultra fine particles of titanium oxide were mixed with the solution to be dispersed for one hour by beads mill dispersion equipment, by which a coating liquid for an undercoat layer was prepared. The viscosity of the solvent used was 5.09 mPa.s at 20° C. and the boiling point thereof was 128° C. at $1\times10^5$ Pa.

Except for these modifications to Example 1, an undercoat layer, a charge generation layer, and a charge transport layer were coated in order as in Example 1, by which a photoconductor was manufactured.

Example 3

Instead of using isobutyl alcohol as a solvent in Example 1, 100 parts by weight of 3-methyl-1-butanol was used to prepare a coating liquid for an undercoat layer. The viscosity of the solvent used was 4.2 mPa.s at 20° C. and the boiling point thereof was 130.8° C. at $1\times10^5$ Pa.

Except for these modifications to Example 1, an undercoat layer, a charge generation layer, and a charge transport layer were coated in order as in Example 1, by which a photoconductor was manufactured.

Example 4

Instead of using isobutyl alcohol as a solvent in Example 1, 100 parts by weight of 1-hexanol was used to prepare a coating liquid for an undercoat layer. The viscosity of the solvent used was 5.2 mPa.s at 20° C. and the boiling point thereof was 157.1° C. at $1\times10^5$ Pa. The drying temperature and the drying time were 160° C. and 30 minutes, respectively.

Except for these modifications to Example 1, an undercoat layer, a charge generation layer, and a charge transport layer were coated in order as in Example 1, by which a photoconductor was manufactured.

Example 5

Instead of using isobutyl alcohol as a solvent in Example 1, 100 parts by weight of 4-methyl-2-pentanol was used to prepare a coating liquid for an undercoat layer. The viscosity of the solvent used was 4.59 mPa.s at 20° C. and the boiling point thereof was 131.8° C. at $1\times10^5$ Pa.

Except for these modifications to Example 1, an undercoat layer, a charge generation layer, and a charge transport layer were coated in order as in Example 1, by which a photoconductor was manufactured.

Example 6

Instead of using isobutyl alcohol as a solvent in Example 1, 100 parts by weight of 2-ethyl-1-butanol was used to prepare a coating liquid for an undercoat layer. The viscosity of the solvent used was 5.63 mPa.s at 20° C. and the boiling point thereof was 147.0° C. at $1\times10^5$ Pa.

Except for these modifications to Example 1, an undercoat layer, a charge generation layer, and a charge transport layer were coated in order as in Example 1, by which a photoconductor was manufactured.

Example 7

Instead of using isobutyl alcohol as a solvent in Example 1, 100 parts by weight of 3-heptanol was used to prepare a coating liquid for an undercoat layer. The viscosity of the solvent used was 7.1 mPa.s at 20° C. and the boiling point thereof was 156.2° C. at $1\times10^5$ Pa. The drying temperature and the drying time were 160° C. and 30 minutes, respectively.

Except for these modifications to Example 1, an undercoat layer, a charge generation layer, and a charge transport layer were coated in order as in Example 1, by which a photoconductor was manufactured.

Example 8

A solution was prepared by solving 10 parts by weight of hydroxystyrene resin and 10 parts by weight of isobutylated melamine resin as resin binders in 100 parts by weight of an isobutyl alcohol solvent. High-purity titanium oxide particles were prepared with an average primary particle diameter of 0.27 μm. The surfaces of the particles were treated beforehand with methylhydrogen polysiloxane. Then, 80 parts by weight of the high-purity titanium oxide particles were mixed with the solution to be dispersed for one hour by beads mill dispersion equipment, by which a coating liquid for an undercoat layer was prepared.

Except for these modifications to Example 1, an undercoat layer, a charge generation layer, and a charge transport layer were coated in order as in Example 1, by which a photoconductor was manufactured.

Example 9

Instead of using isobutyl alcohol as a solvent in Example 1, a mixed solvent of 50 parts by weight of isobutyl alcohol and 50 parts by weight of tetrahydrofuran was used to prepare a coating liquid for an undercoat layer.

Except for these modifications to Example 1, an undercoat layer, a charge generation layer, and a charge transport layer were coated in order as in Example 1, by which a photoconductor was manufactured.

Example 10

An undercoat layer was formed by using the coating liquid for the undercoat layer in Example 1. Thereafter, 1 part by weight of Y-type titanylphthalocyanine as a charge generation material, 20 parts by weight of 4-oxo-3,5-di-tertiary-butyl-2,5-cyclohexadiene-1-ylidene-(4-chlorophenylazo)-methylene as an electron transport material, 30 parts by weight of N,N'-bis(3-methylphenyl)-N,N'-diphenyl-1,1'-biphenyl-4,4'-diamine as a hole transport material, and 40 parts by weight of polycarbonate Z resin with a viscosity-average molecular weight of 50,000 were solved by 300 parts by weight of tetrahydrofuran solvent. Then, the solution was applied by a dip coating method to a thickness of 30 μm to form a photosensitive layer before being dried at 100° C. for 60 minutes, by which a photoconductor was manufactured.

Example 11

A solution was prepared in which, instead of using hydroxystyrene resin and isobutylated melamine resin as resin binders in Example 1, 10 parts by weight of alcohol-soluble nylon (CM8000) was solved in a solvent for which 100 parts by weight of dichloromethane and 100 parts by weight of isobutyl alcohol were used instead of isobutyl alcohol in Example 1. Ultra fine particles of titanium oxide were prepared with primary particle diameters of 0.03 μm to 0.05 μm. The surfaces of the particles were treated beforehand with methylhydrogen polysiloxane. Then, 40 parts by weight of the ultra fine particles of titanium oxide were mixed with the solution to be dispersed for one hour by beads mill dispersion equipment, by which a coating liquid for an undercoat layer was prepared. The viscosity of dichloromethane used as the solvent was 0.425 mPa.s at 20° C. and the boiling point thereof was 39.75° C. at $1\times10^5$ Pa.

Except for these modifications to Example 1, an undercoat layer, a charge generation layer, and a charge transport layer were coated in order as in Example 1, by which a photoconductor was manufactured.

COMPARATIVE EXAMPLE 1

Instead of using isobutyl alcohol as a solvent in Example 1, a solvent of 100 parts by weight of methyl alcohol was used to prepare a coating liquid for an undercoat layer. The viscosity of the solvent used was 0.59 mPa.s at 20° C. and the boiling point thereof was 64.5° C. at $1\times10^5$ Pa.

Except for these modifications to Example 1, an undercoat layer, a charge generation layer, and a charge transport layer were coated in order as in Example 1, by which a photoconductor was manufactured.

COMPARATIVE EXAMPLE 2

Instead of using isobutyl alcohol as a solvent in Example 1, 100 parts by weight of isopropyl alcohol was used to prepare a coating liquid for an undercoat layer. The viscosity of the solvent used was 2.41 mPa.s at 20° C. and the boiling point thereof was 82.3° C. at $1\times10^5$ Pa.

Except for these modifications to Example 1, an undercoat layer, a charge generation layer, and a charge transport layer were coated in order as in Example 1, by which a photoconductor was manufactured.

COMPARATIVE EXAMPLE 3

Instead of using isobutyl alcohol as a solvent in Example 1, 100 parts by weight of 1-butanol was used to prepare a coating liquid for an undercoat layer. The viscosity of the solvent used was 2.95 mPa.s at 20° C. and the boiling point thereof was 117.7° C. at $1\times10^5$ Pa.

Except for these modifications to Example 1, an undercoat layer, a charge generation layer, and a charge transport layer were coated in order as in Example 1, by which a photoconductor was manufactured.

COMPARATIVE EXAMPLE 4

Instead of using isobutyl alcohol as a solvent in Example 1, 100 parts by weight of 1,4-dioxane was used to prepare a coating liquid for an undercoat layer. The viscosity of the solvent used was 1.31 mPa.s at 20° C. and the boiling point thereof was 101.3° C. at $1\times10^5$ Pa.

Except for these modifications to Example 1, an undercoat layer, a charge generation layer, and a charge transport layer were coated in order as in Example 1, by which a photoconductor was manufactured.

COMPARATIVE EXAMPLE 5

Instead of using isobutyl alcohol as a solvent in Example 1, 100 parts by weight of tetrahydrofuran was used to prepare a coating liquid for an undercoat layer. The viscosity of the solvent used was 0.55 mPa.s at 20° C. and the boiling point thereof was 66° C. at $1\times10^5$ Pa.

Except for these modifications to Example 1, an undercoat layer, a charge generation layer, and a charge transport layer were coated in order as in Example 1, by which a photoconductor was manufactured.

COMPARATIVE EXAMPLE 6

Instead of using isobutyl alcohol as a solvent in Example 1, 100 parts by weight of methyl isobutyl ketone was used to prepare a coating liquid for an undercoat layer. The viscosity of the solvent used was 0.59 mPa.s at 20° C. and the boiling point thereof was 115.9° C. at $1\times10^5$ Pa.

Except for these modifications to Example 1, an undercoat layer, a charge generation layer, and a charge transport layer were coated in order as in Example 1, by which a photoconductor was manufactured.

COMPARATIVE EXAMPLE 7

Instead of using isobutyl alcohol as a solvent in Example 1, 100 parts by weight of diethyl ketone was used to prepare a coating liquid for an undercoat layer. The viscosity of the solvent used was 0.48 mPa.s at 20° C. and the boiling point thereof was 102.0° C. at $1\times10^5$ Pa.

Except for these modifications to Example 1, an undercoat layer, a charge generation layer, and a charge transport layer were coated in order as in Example 1, by which a photoconductor was manufactured.

COMPARATIVE EXAMPLE 8

Instead of using isobutyl alcohol as a solvent in Example 1, 100 parts by weight of 2-methoxyethanol was used to prepare a coating liquid for an undercoat layer. The viscosity of the solvent used was 1.72 mPa.s at 20° C. and the boiling point thereof was 124.6° C. at $1\times10^5$ Pa.

Except for these modifications to Example 1, an undercoat layer, a charge generation layer, and a charge transport layer were coated in order as in Example 1, by which a photoconductor was manufactured.

COMPARATIVE EXAMPLE 9

Instead of using isobutyl alcohol as a solvent in Example 1, 100 parts by weight of 2-ethoxyethanol was used to prepare a coating liquid for an undercoat layer. The viscosity of the solvent used was 2.05 mPa.s at 20° C. and the boiling point thereof was 135.6° C. at $1\times10^5$ Pa.

Except for these modifications to Example 1, an undercoat layer, a charge generation layer, and a charge transport layer were coated in order as in Example 1, by which a photoconductor was manufactured.

COMPARATIVE EXAMPLE 10

Instead of using isobutyl alcohol as a solvent in Example 1, a mixed solvent of 100 parts by weight of dichloromethane, 60 parts by weight of methyl alcohol, and 40 parts by weight of 1-butanol was used.

Except for these modifications to Example 1, an undercoat layer, a charge generation layer, and a charge transport layer were coated in order as in Example 1, by which a photoconductor was manufactured.

COMPARATIVE EXAMPLE 11

Instead of using isobutyl alcohol as a solvent in Example 1, 100 parts by weight of 2-heptanol was used to prepare a coating liquid for an undercoat layer. The viscosity of the solvent used was 6.53 mPa.s at 20° C. and the boiling point thereof was 160.4° C. at $1\times10^5$ Pa.

Except for these modifications to Example 1, an undercoat layer, a charge generation layer, and a charge transport layer were coated in order as in Example 1, by which a photoconductor was manufactured.

A viscosity and a boiling point of each of the organic solvents and solvents used in the above-described Examples 1 to 11 and the Comparative Examples 1 to 11 are summarized in Table 1. In addition, results of evaluations of photoconductors obtained in the Examples and the Comparative Examples are shown in Table 2. The evaluations were carried out considring sedimentation of fillers in coating liquids left at rest in an atmosphere at a normal temperature and using printed images.

TABLE 1

| | Organic solvent used | | | Solvent viscosity at 20° C.(mPa · s) | | | Boiling point at $1 \times 10^5$ Pa(= 1 atm (760 mmHg)) (° C.) | | |
|---|---|---|---|---|---|---|---|---|---|
| Example 1 | isobutyl alcohol | | | 3.95 | | | 107.9 | | |
| Example 2 | 2-methyl-1-butanol | | | 5.09 | | | 128 | | |
| Example 3 | 3-methyl-1-butanol | | | 4.2 | | | 130.8 | | |
| Example 4 | 1-hexanol | | | 5.2 | | | 157.1 | | |
| Example 5 | 4-methyl-2-pentanol | | | 4.59 | | | 131.8 | | |
| Example 6 | 2-ethyl-1-butanol | | | 5.63 | | | 147.0 | | |
| Example 7 | 3-heptanol | | | 7.1 | | | 156.2 | | |
| Example 8 | isobutyl alcohol | | | 3.95 | | | 107.9 | | |
| Example 9 | isobutyl alcohol | tetra- hydrofuran | | 3.95 | 0.55 | | 107.9 | 66 | |
| Example 10 | isobutyl alcohol | | | 3.95 | | | 107.9 | | |
| Example 11 | isobutyl alcohol | dichloro- methane | | 3.95 | 0.425 | | 107.9 | 39.75 | |
| Comparative Example 1 | methyl alcohol | | | 0.59 | | | 64.5 | | |
| Comparative Example 2 | isopropyl alcohol | | | 2.41 | | | 82.3 | | |
| Comparative Example 3 | 1-butanol | | | 2.95 | | | 117.7 | | |
| Comparative Example 4 | 1,4-dioxane | | | 1.31 | | | 101.3 | | |
| Comparative Example 5 | tetrahydrofuran | | | 0.55 | | | 66 | | |
| Comparative Example 6 | methyl isobutyl ketone | | | 0.59 | | | 115.9 | | |
| Comparative Example 7 | diethyl ketone | | | 0.48 | | | 102.0 | | |
| Comparative Example 8 | 2-methoxyethanol | | | 1.72 | | | 124.6 | | |
| Comparative Example 9 | 2-ethoxyethanol | | | 2.05 | | | 135.6 | | |
| Comparative Example 10 | dichloro- methane | methyl alcohol | 1-butanol | 0.425 | 0.59 | 2.95 | 39.75 | 64.5 | 117.7 |
| Comparative Example 11 | 2-heptanol | | | 6.53 | | | 160.4 | | |

TABLE 2

| | Evaluation of sedimentation after leaving at rest at ordinary temperature for 1 week | Evaluation of sedimentation after leaving at rest at ordinary temperature for 1 month | Evaluation of sedimentation after leaving at rest at ordinary temperature for 3 months | Evaluation of printed image in half-tone |
|---|---|---|---|---|
| Example 1 | No sediment | No sediment | No sediment | Good |
| Example 2 | No sediment | No sediment | No sediment | Good |
| Example 3 | No sediment | No sediment | No sediment | Good |
| Example 4 | No sediment | No sediment | A little sediment produced | Good |
| Example 5 | No sediment | No sediment | No sediment | Good |
| Example 6 | No sediment | No sediment | No sediment | Good |
| Example 7 | No sediment | No sediment | No sediment | Good |
| Example 8 | No sediment | No sediment | No sediment | Good |
| Example 9 | No sediment | No sediment | A little sediment produced | Good |
| Example 10 | No sediment | No sediment | No sediment | Good |
| Example 11 | No sediment | No sediment | No sediment | Good |

TABLE 2-continued

| | Evaluation of sedimentation after leaving at rest at ordinary temperature for 1 week | Evaluation of sedimentation after leaving at rest at ordinary temperature for 1 month | Evaluation of sedimentation after leaving at rest at ordinary temperature for 3 months | Evaluation of printed image in half-tone |
|---|---|---|---|---|
| Comparative Example 1 | No sediment | Sediment produced | — | Nonuniform gray level |
| Comparative Example 2 | No sediment | Sediment produced | — | Good |
| Comparative Example 3 | No sediment | Sediment produced | — | Good |
| Comparative Example 4 | Sediment produced | — | — | Good |
| Comparative Example 5 | Sediment produced | — | — | Good |
| Comparative Example 6 | Sediment produced | — | — | Nonuniform gray level |
| Comparative Example 7 | Sediment produced | — | — | Nonuniform gray level |
| Comparative Example 8 | No sediment | Sediment produced | — | Nonuniform gray level |
| Comparative Example 9 | No sediment | Sediment produced | — | Nonuniform gray level |
| Comparative Example 10 | No sediment | No sediment | Sediment produced | Good |
| Comparative Example 11 | No sediment | No sediment | No sediment | Nonuniform printed image produced due to residual solvent |

As has been explained in the foregoing, according to the present invention, an improved coating liquid for the undercoat layer can be obtained in which dispersion of metal oxide fine particles is enhanced. This makes it possible to provide a superior photoconductor and a manufacturing method thereof, in which the photoconductor has a uniform undercoat layer and, in turn, excellent electrophotographic characteristics, in particular, excellent image characteristics and external appearance characteristics. Moreover, when an alcohol solvent with a branch structure is used, an improved coating liquid for an undercoat layer can be obtained in which dispersion is enhanced by a solvent with a lower boiling point.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A photoconductor for electrophotography comprising:

a conductive substrate;

an undercoat layer provided on the conductive substrate, the undercoat layer containing metallic oxide fine particles and being formed by applying a coating liquid for the undercoat layer onto the conductive substrate, the coating liquid for the undercoat layer containing an organic solvent having a boiling point at $1\times10^5$ Pa of about 160° C. or less and a viscosity at 20° C. of about 3.0 mPa.s or more; and a photosensitive layer provided on the undercoat layer.

2. The photoconductor for electrophotography as claimed in claim 1, wherein the photosensitive layer is formed by layering a charge generation layer and a charge transport layer.

3. The photoconductor for electrophotography as claimed in claim 1, wherein the photosensitive layer is formed as a single layer containing a charge generation material and a charge transport material.

4. The photoconductor for electrophotography as claimed in claim 1, wherein the organic solvent is an alcohol solvent having 4 or more carbon atoms.

5. The photoconductor for electrophotography as claimed in claim 4, wherein the organic solvent is an alcohol solvent having a branch structure.

6. A method of manufacturing a photoconductor for electrophotography, comprising:

preparing a conductive substrate;

preparing a coating liquid for an undercoat layer, the coating liquid containing metallic oxide fine particles and an organic solvent, and the organic solvent having a boiling point at $1\times10^5$ Pa of about 160° C. or less and a viscosity at 20° C. of about 3.0 mPa.s or more;

applying the coating liquid onto the conductive substrate to form the undercoat layer; and forming a photosensitive layer on the undercoat layer.

* * * * *